United States Patent [19]

Hirmann

[11] 3,946,641

[45] Mar. 30, 1976

[54] DRIVE ARRANGEMENT TO PRODUCE A ROTARY OR TURNING MOTION BY MEANS OF A FLUID OR GASEOUS PRESSURE MEDIUM

[75] Inventor: Georg Hirmann, Zurich, Switzerland

[73] Assignee: Inventa Ag fur Forschung und Forschung und Patentveruertung Zurich, Zurich, Switzerland

[22] Filed: Oct. 30, 1973

[21] Appl. No.: 411,025

[30] Foreign Application Priority Data

Nov. 1, 1972 Switzerland ..... 15908/72
Oct. 17, 1973 Germany ..... 2351990

[52] U.S. Cl. ..... 91/491; 91/180; 417/273; 92/92

[51] Int. Cl.[2] ..... F01B 13/06; F04B 1/06

[58] Field of Search ..... 417/437, 412, 474, 477; 418/45; 92/72, 92; 91/180

[56] References Cited

UNITED STATES PATENTS

| | | | |
|---|---|---|---|
| 1,924,423 | 4/1933 | Svenson | 92/72 |
| 2,428,619 | 10/1947 | Douglas | 418/45 |
| 2,617,362 | 11/1952 | Parsons | 418/45 |
| 2,651,264 | 9/1953 | Bruckmann | 418/45 |
| 3,014,348 | 12/1961 | Mauch | 417/473 |
| 3,097,366 | 7/1963 | Winchell | 417/412 |
| 3,280,703 | 10/19[illegible]6 | Humphrey | 92/72 |
| 3,669,578 | 6/1972 | Nameny | 418/45 |

FOREIGN PATENTS OR APPLICATIONS

| | | | |
|---|---|---|---|
| 840,944 | 5/1939 | France | 417/273 |
| 1,195,011 | 5/1959 | France | 417/412 |
| 1,218,819 | 5/1960 | France | 91/180 |

*Primary Examiner*—William L. Freeh
*Attorney, Agent, or Firm*—Browdy and Neimark

[57] ABSTRACT

A drive arrangement for producing a rotary motion by means of a fluid or gaseous pressure medium in which a working shaft and an eccentric part within a housing are acted upon by at least one freely deformable expansion cell mounted between the housing and the eccentric part in such a manner that expansion of the collapsible cell exerts a rotational moment on the eccentric part, a force that is directed along the central axis and therefore along the working shaft. The expansion cells are connected with the working medium by suitable control means.

13 Claims, 11 Drawing Figures

DRIVE ARRANGEMENT TO PRODUCE A ROTARY OR TURNING MOTION BY MEANS OF A FLUID OR GASEOUS PRESSURE MEDIUM

The invention concerns a drive arrangement for producing a rotary or swivel motion by means of a fluid or gaseous pressure medium, said drive arrangement including a housing with a working shaft mounted therein and a cylindrical eccentric part operatively connected to said shaft, and with said drive arrangement including at least one inflatable expansion cell, said cell being mounted between the inner wall of the housing and the eccentric part, distributed around the circumference of the latter, operatively connected to it, and capable of connection with the working medium by means of control means.

This drive is intended to be inexpensive to manufacture, simple in design, reliable in operation, harmless to the environment and in particular characterized by a significantly lower weight per horsepower than the hydraulic or pneumatic drives known today.

Motors of this type have already been proposed, but have not gone into mass production; the expansion chambers of said motors are mounted on the supporting surfaces and because of the design, are subject to significant frictional losses during operation because of the relative movement of the sections of the chamber walls, especially the edge sections, but also undergo considerable tensile stresses with peak stresses in the border areas of the chambers, resulting in considerably shortened lifetimes for such expansion chambers.

The drive arrangement according to the invention overcomes these disadvantages by virtue of the fact that the expansion cell is made in the form of a freely deformable collapsing cell, such that the cell wall is squeezed when the volume of the collapsing cell changes, so that the difference between the circumference of the rotor and the inside of the housing is compensated by squeezing of the expansion cell or between a pressure plate and an eccentrically mounted bearing, and where inflation of at least one collapsible cell on the eccentric part results in a force directed along its central axis and therefore the imposition of a turning moment on the working shaft.

Such a motor can be manufactured at low cost. One of its characteristic features is that its volumetric efficiency is very high and the frictional losses are extremely low.

According to another feature of the present invention, the eccentric part has a cylindrical sleeve section and a squeezable cell operatively connected with it. The manufacture of the sleeve section is very simple from the manufacturing standpoint.

According to a further feature of the present invention, which will be discussed in more detail later, between the eccentric part and the expansion cell, an intermediate part is rotatably mounted on the former, e.g., a ring or cylinder, resulting in extremely low friction design. The same effect can be achieved by pressure plates, in accordance with the present invention, which are operatively linked directly with the collapsing cells, which prevent grinding of the collapsing cells on the surfaces with which they are in contact and (what is most important) offer a very large bearing surface (hydraulically active surface) for the freely deformable expension cells in a small space. If roller bearings are used for the intermediate part, in accordance with another feature of the present invention, further reduction of friction can be achieved thereby.

It is also advantageous, in the sense of a simple mounting when a cell is operatively connected with one of the supports of the bearing surfaces in a region which is small relative to the bearing surfaces, e.g., by means of the connections for the working medium.

In this sense, the connections can be made in the form of pressed-in connections.

A simple design of the drive arrangement is achieved if the housing of the drive consists of segments with clamping plates. It is also very important that the drive arrangement is made in the form of a rotary drive and is equipped with two collapsible cells that operate alternately on the eccentric shaft. Such a rotary drive is not only simple in design but also works with a high degree of efficiency and is practically maintenance-free.

In a further embodiment which can also be of considerable value in practice, the rotary drive is achieved by means of a single collapsible cell and the shaft is returned by an external force, e.g., an incorporated spring, e.g., in a door opener.

In certain drive arrangements of this kind, it is absolutely necessary to provide a coupling means between the collapsing rotor and the housing, in order to prevent a change in the angle of rotation between the rotor and the housing and thereby ensure reliable operation of the drive arrangement. As such a coupling means one can use for example a guide in the housing which serves to accept an arm of the rotor which extends preferably radially, or an appropriate pivot coupling (so-called Oldham coupling) can be used with an intermediate disk, such as are generally known.

Sample embodiments of the subject of the invention will now be described with reference to the schematic diagrams:

FIG. 1: A cross section through a rotary drive with expansion cells, which act on an eccentric shaft through a rotor shaft, along line II–II in FIG. 2.

FIG. 1*a*: A schematic diagram showing the forces exerted by the expansion all on the rotor.

FIG. 2: A lengthwise section of the rotary drive according to FIG. 1, along line I–I.

FIG. 3: A schematic perspective representation of a collapsing rotor mounted in a housing to prevent distortion;

FIG. 4: A representation similar to that in FIG. 3, in which the guidance is achieved by means of a coupling, shown in the form of an exploded diagram, FIG. 5: A cross section through a rotary drive with three expansion cells which act on an eccentric shaft through pressure plates.

FIG. 6: A lengthwise section of the rotary drive according to FIG. 3.

FIG. 7: A cross section through a rotary drive with alternately acting expansion cells, acting on an eccentric shaft through a rotor shaft, FIG. 8: A cross section through a rotary drive with alternately acting expansion cells, which act on an eccentric shaft through pressure plates.

FIG. 9: A cross-section through a rotary drive with one inflatable expansion cell, acting on an eccentric shaft through a rotor shaft.

FIG. 10: A cross-section through a rotary drive with one inflatable expansion cell acting on an eccentric shaft through one spring activated pressure plate.

FIG. 1 shows a cross section of a rotary drive with a sleeve tube 1, a drive-control shaft 2 eccentrically mounted with respect to drive shaft axis 3, a hollow cylindrical revolving rotor 4 mounted on drive-control shaft 2, with the lengthwise axis of said revolving rotor designated as 4*a*, as well as expansion cells, so-called collapsing cells 5, 6 and 7, made of rubber or plastic elastic material. These collapsing cells operate freely in such manner that the edge portions of the membranes of the collapsing cells can roll or squeeze freely so that a movement of the edge portion of the cell, which is practically free of friction or additional stress, results. Each of these folding cells is connected with pressed-in nipples 8 with revolving rotor 4 and with radial bores 9 in the revolving rotor. The drive-control shaft 2 contains channels 10 and 11 for the application and removal of the pressure medium.

FIG. 2 shows housing covers 57 and 58, the eccentric drive-control shaft 2 with a counterweight 60, the revolving rotor 4 with its bearings 62 and 63. The expansion cell 5 on rotor 4 is in the neutral functional position. It is connected with revolving rotor 4 by pressed-in nipple 8, where the latter expands into radial bore 9. FIGS. 1 and 2 constitute an example of a non-reversible drive, e.g., for a compressed air feed. In the latter, the pressure medium is supplied through a connection 68 at bore 11 of a segment section 70 and vents to the expansion cell 7. Through the other segment section on the back, on the other hand, the expansion cell 6 is exhausted through bore 11 into the internal cavity of revolving rotor 4, from which the exhaust is accomplished into the open air through bore 72, 73. This type of exhaust can reduce the exhaust noise to a scarcely audible minimum. In a reversible version of the same drive, the exhaust channel is displaced to the shaft.

Hence, to the extent that channels 10 and 11 are connected reversibly to the supply line, the drive is reversible. To turn drive shaft 3*a* to the right, channel 11 is pressurized, whereupon expansion cell 7 attempts to expand in the radial direction. The magnitude of the radial force 12 acting on revolving rotor 4 is a function of the hydraulically-active surface 13 of the expansion cell as well as the excess pressure of the pressure medium. The rotary moment which is developed is the product of this radial force 12 and the instantaneous distance 14 of the force vector from axis 3, as can be seen in FIG. 1*a*. In the instantaneous functional position shown in the diagram, expansion cell 5 is in the neutral position and the expansion cell 6 is exhausted through channel 10. The direction of rotation of the drive shaft 3*a* in this case corresponds to the arrow 15. During the rotation of drive shaft 2 around axis 3, the expansion cells are pressurized in the order 7, 5, 6. The curve of the rotational moment has a 3-phase sinusoidal shape, with the characteristic that the change in the hydraulically active expansion cell surface during the rotation results in a steeper rise and a flatter decline of the curve.

Rotation of drive shaft 3*a* in the opposite direction is accomplished by reversing channels 10 and 11, so that in the diagram expansion cell 6 is pressurized and the order of pressurization of the cells is 6, 5, 7.

In the motor according to FIGS. 1 and 2 the support surfaces of the folding cell are not parallel, so that, in addition to the radially acting forces, tangential forces are also created which act in the opposite direction on the housing of the rotor. In order to prevent a relative rotation of the rotor with respect to the housing, additional means are required.

FIG. 3 shows in schematic form the collapsing rotor. Revolving rotor 90 with a guide 92 firmly fastened thereto and a roller 94 attached to it, is guided in a slot 96 in a housing 98, which corresponds to tube 1 in the embodiment according to FIGS. 1 and 2.

FIG. 4 also shows in schematic form a collapsing rotor 102. At the end of the rotor 102, pins 104 and 106 with rolls 108 and 110 are mounted opposite each other. Similar rolls 112, 114 are mounted in the housing opposite the end of the rotor, on the inside, in a position which is turned through 90°. The coupling of the collapsing rotor 102 with the housing is accomplished by means of a coupling ring 116 with slot openings 118, 120, 122 and 124 which accept rolls 108, 110, 112 and 114. The coupling ring in familiar fashion allows axial misalignment between the rotor and the housing, but it prevents any relative rotation (Oldham coupling). Depressions 118, 120, 122 and 124, as we have said, serve to accept rolls 108, 110 and 112, 114. In this manner, rotor 102 can perform a movement in the housing similar to that of a connecting rod head in a crank drive, i.e. a revolving movement around an eccentric axis without performing a rotary movement around its own axis.

FIG. 5 shows a cross section through a rotary drive in which the elastic expansion cells 16, 17 and 18 made of plastic film act through eccentric bearing 22 on an eccentric shaft 24 with axis of rotation 23. The segmental housing part 25, 26, 27, held together by tension bands or clamps 31, 32, 33, contain control channels 28, 29, 30. The bearings of pressure plates 19, 20, 21 are located in bearing covers 76 and 84 (FIG. 6). Connection of channels 28–30 with the expansion cells is accomplished by means of pressed-in nipple 34. The control element (not shown) ensures that in order to turn shaft 24 in the direction of the arrow 35 the expansion cells will be controlled in the order 16, 17, 18. Rotation in the opposite direction is achieved by control in accordance with cell sequence 18, 17, 16.

FIG. 6 shows the lengthwise section of the drive according to FIG. 2. In housing section 26 with control channel 29, cover 76 with control channel 77 as well as eccentric shaft 24 with eccentric 78, servo valve spool part 79 and expansion cell 17 which is in the neutral functioning position with connecting and fastening nipples 34 and cover 84 is provided. Expansion cell 16 acts on eccentric bearing 22 through pressure plate 19. Bearings 87, 88 of pressure plate 21 are also visible, as well as the counterweight 81 of eccentric shaft 24 to balance eccentric 78.

FIG. 7 shows a swivel drive in cross section, with a sleeve tube 36, a rotor roller 37, elastic expansion cells 38, 39 with connecting nipples 40, 41 as well as an eccentric shaft 42. In FIG. 7 the drive is shown in the neutral central position. Control can be accomplished, for example, with a 4-way valve. To execute a rotary movement in the direction of the arrow 43, the connection is made through nipple 40 with the pressure line and through nipple 41 with the exhaust line. When the two connections are reversed, shaft 42 will turn in the direction of arrow 44. The rotor roller 37 does not itself rotate during the rotation but performs a planetary movement without rotating itself. The maximum possible swivel angle 45 for such a drive is approximately 160°.

FIG. 8 shows a cross section of a swivel drive with a housing 46, expansion cells 47, 48 with connecting nipples 49, 50, pressure plates 51, 52, eccentric shaft 53 with a swivel axis 54 and an eccentric bearing 55. The design of this drive is similar to the drive shown in FIGS. 1 and 2, and the type of function is comparable to the control in the sense of the embodiment according to FIGS. 5 and 6.

The drives that have been shown and described have the following features in common:

a. The approximately radially acting production of force is accomplished through elastic expansion cells.

b. The possibility of developing large hydraulically active surfaces with a small structural volume is made possible by using inflatable cells, e.g., made of rubber-elastic or plastic-elastic material.

c. The change in volume of the expansion cells is accomplished by squeezing of the cell wall, in other words, without any sliding friction.

d. Extremely noise-free operation is achieved especially in embodiments with a revolving rotor.

e. Lubricating qualities are not required for the pressure medium.

f. Low manufacturing costs are possible especially by virtue of the possibility of making the expansion cells from sheets by welding, gluing or vulcanization.

g. All drives can be operated either with a fixed housing and a movable shaft or a fixed shaft and a movable housing.

These drives are generally usable to produce any kind of rotary or turning movement. A further expansion of the range of application with respect to known drives, however, can be anticipated by virtue of the two new features of this drive:

No lubrication required by the pressure medium

Economical possibility of formation of large active areas.

Figures 1, 1A:
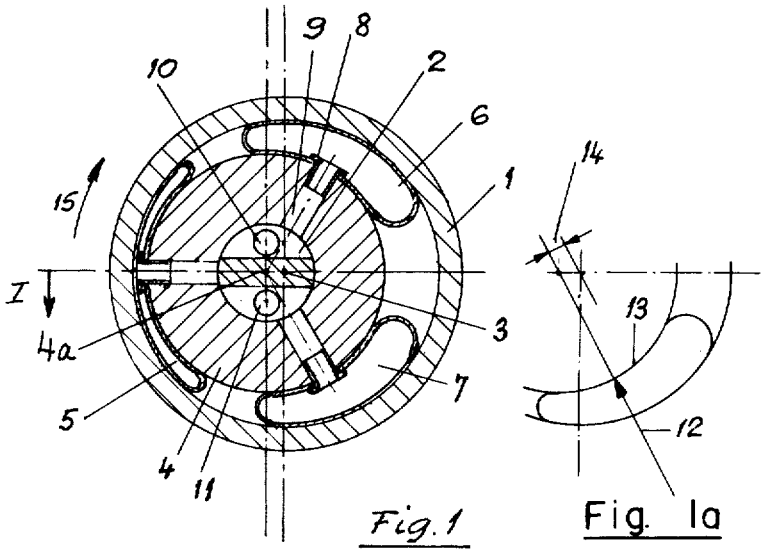
Figure 5:
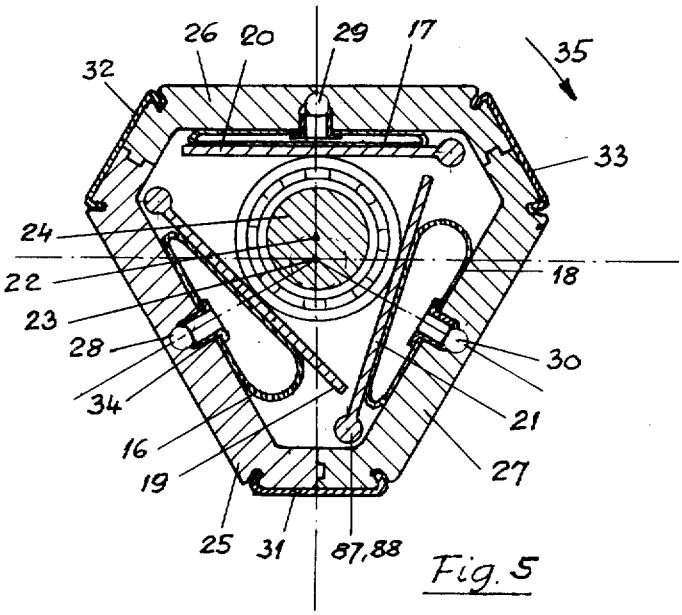
Figure 2:
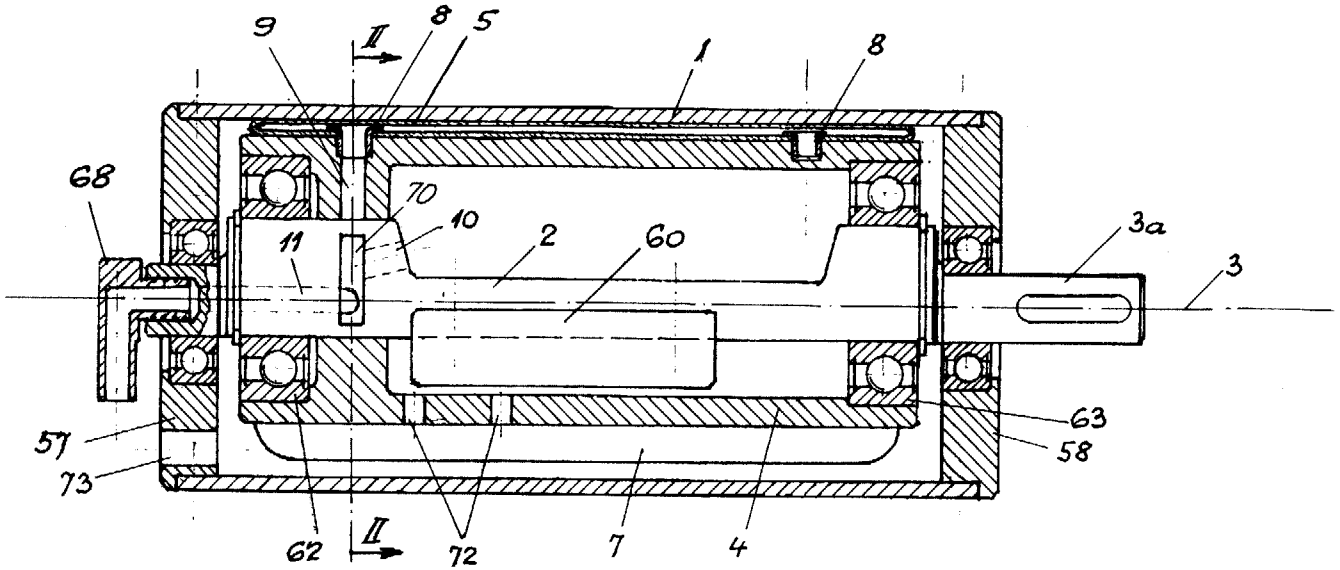
Figure 3:
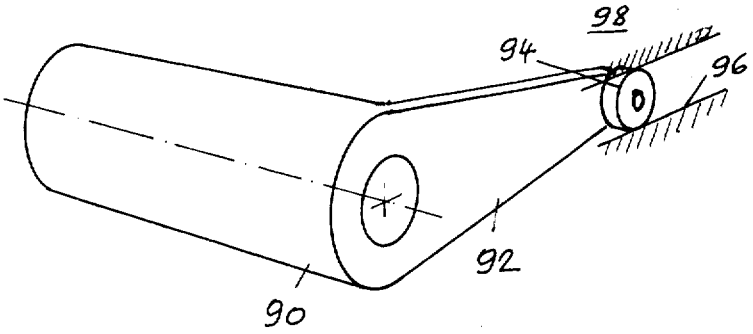
Figure 4:
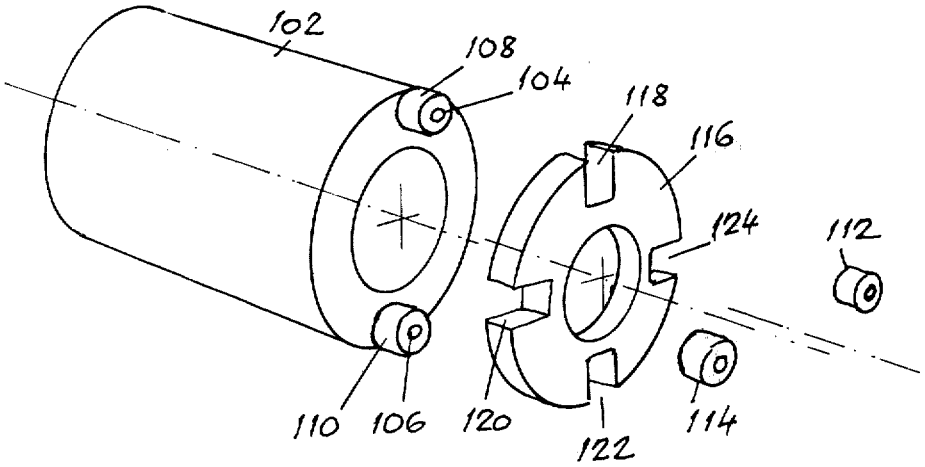
Figure 6:
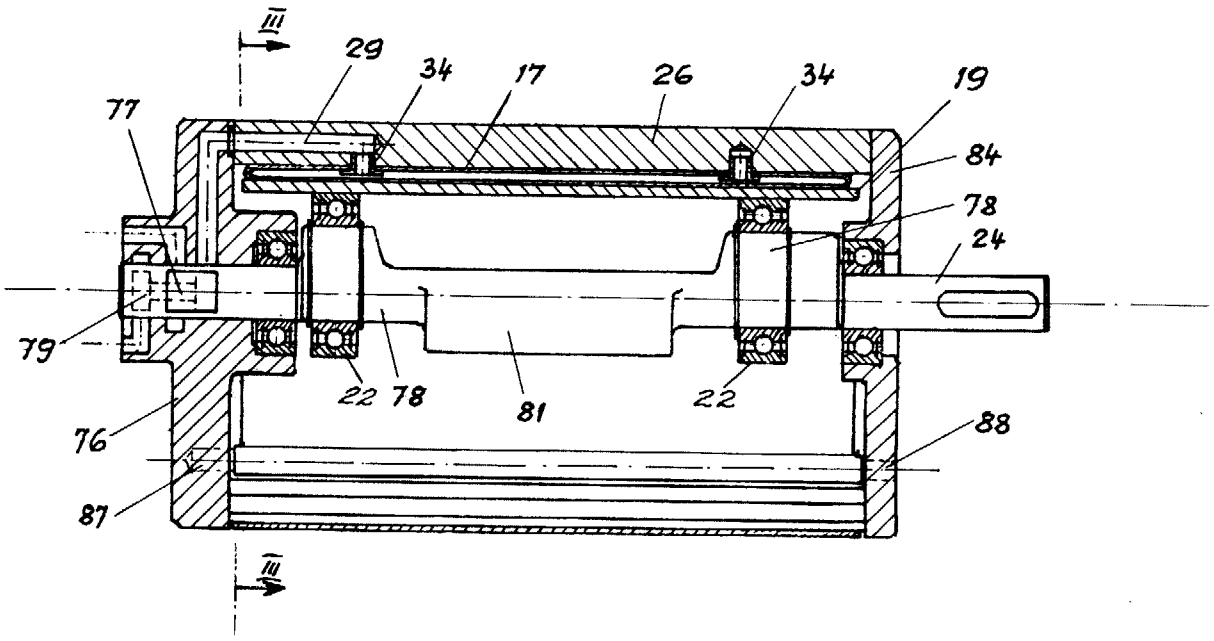
Figure 7:
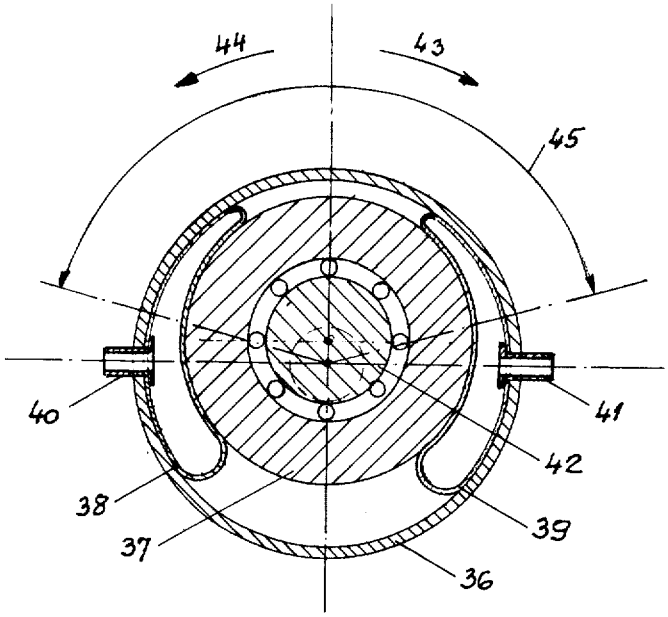
Figure 8:
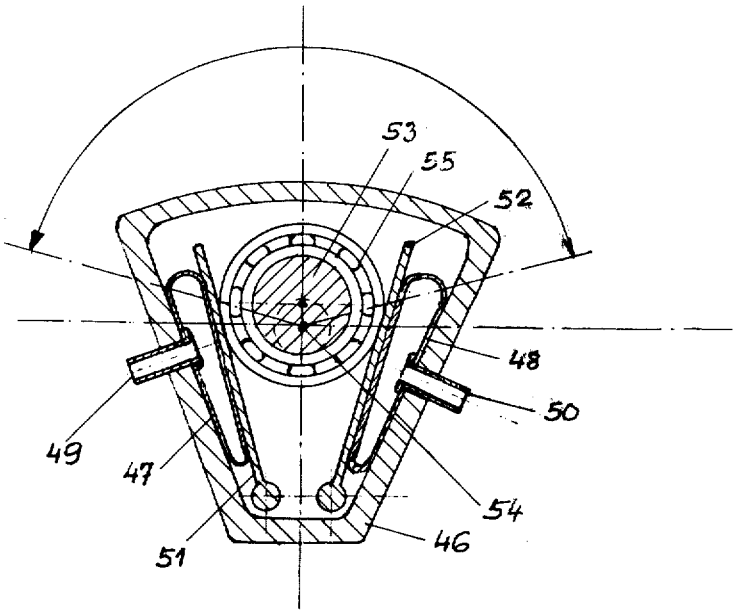
Figure 9:
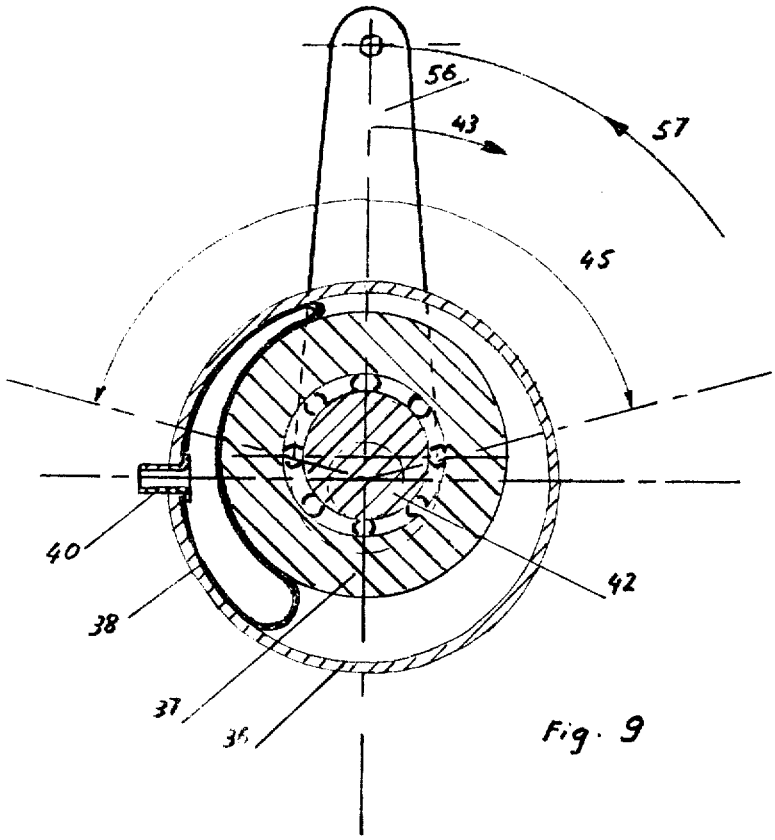
FIG. 9 shows a swivel drive which is similar to FIG. 7 but having only one inflatable pressure cell. Through an external force 57, an external lever return means 56 acts on the drive system to bring the cell back to its minimum volume position.
Figure 10:
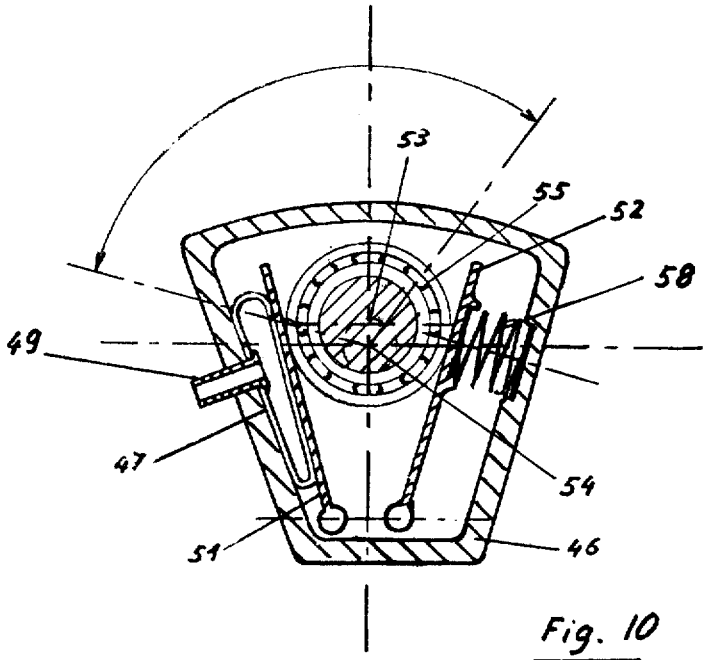
FIG. 10 shows a swivel drive which is similar to FIG. 8, however with one of the inflatable pressure cells replaced by a spring 58 to automatically return the system to the minimum volume position of the cell 47 as soon as it becomes deflated.

The first characteristic makes possible the use of any non-aggressive pressure medium as an energy carrier, such as untreated compressed air, tap water, as well as cold and non-explosive pressure gases with characteristics that are not environmentally harmful, which have not yet been used. By virtue of these properties and with the additional feature of a low unit power of the drive, new possibilities are opened up for construction of motor vehicles, ships and aircraft. A further application of the drive, according to the embodiments shown in FIGS. 1 to 6, is as stepping and servo motors.

The rotary drives in FIGS. 1 to 6 are shown with three expansion cells each since this is the minimum number of cells required to achieve continuous rotation. In order to achieve a high uniformity of the rotational moment, it is possible to use a large number of expansion cells.

The drives in FIGS. 1 to 6 are shown as sample embodiments with rotary slider control. Of course, other types of control may be used. When using the rotary drive described above for stepping motors, in the embodiments according to FIGS. 1 and 2, the expansion cells are connected to the sleeve tube. The rotary slide control is eliminated and replaced by external control.

In the case of swivel drives with external return or resetting forces, for example, exerted by a spring, one expansion cell instead of two will suffice.

Basically it is also possible to have the expansion cell(s) or pressure plates act directly on the eccentric part without intermediate connection of a ring or cylinder rotatably mounted on the eccentric part.

It will be obvious to those skilled in the art that various changes may be made without departing from the scope of the invention and the invention is not to be considered limited to what is shown in the drawings and described in the specification.

What is claimed is:

1. A drive arrangement for executing a rotary or swivel motion by means of a liquid or gaseous pressure medium, comprising:

a housing;

a working shaft mounted in said housing;

an eccentric part operatively connected to said shaft;

at least one inflatable expansion cell mounted between the internal wall of said housing and said eccentric part along the outer surface of said eccentric part; and being operatively connected thereto; and input and output means connected at a single location to said cell for feeding and exhausting pressure medium to and from said cell in a predetermined sequence;

wherein said expansion cell is in the form of a freely inflatable cell attached to said input means in a small area with respect to the total surface area of said cell such that during a change in volume of said cell, said cell squeezes and the difference between the circumference of said eccentric part and the interior of said housing is at least partially taken up by the squeezing of said expansion cell and wherein in the minimum volumne phase of the sequence, the periphery of said eccentric part confronts the surface of the internal wall of said housing forming substantially similar surfaces so that a maximum area in a tangential position of said expansion cell contacts said eccentric part or the internal wall of said housing; whereby when said expansion cell expands, said eccentric part moves away from said housing and said expansion cell exerts a rotational moment on said eccentric part, a force that is directed along the central axis thereof and therefore along said working shaft.

2. A drive arrangement in accordance with claim 1 further including an intermediate part axially surrounding said eccentric part and rotatably connected thereto between said eccentric part and said expansion cell.

3. A drive arrangement in accordance with claim 2 wherein said intermediate part is on roller bearings.

4. A drive arrangement in accordance with claim 2 further including coupling means provided between said intermediate part and said housing, in order to prevent a change in the angle of rotation between said intermediate part and said housing.

5. A drive arrangement in accordance with claim 4, wherein said coupling means are made in the form of an arm of said intermediate part that extends radially and is supported in a slot in the housing or as a cardan drive, flexible shaft or Oldham coupling.

6. A drive arrangement in accordance with claim 1 wherein said eccentric part has a cylindrical sleeve section and said expansion cells are operatively connected thereto.

7. A drive arrangement in accordance with claim 1 further including pressure plates operably connected directly with said expansion cells.

8. A drive arrangement in accordance with claim 1, wherein said connections are made in the form of pressed-in working medium connections.

9. A drive arrangement in accordance with claim 1, wherein said housing is made in the form of radial segmental parts with surfaces that permit clamping.

10. A drive arrangement in accordance with claim 1 in the form of a swivel drive and including two expansion cells which act alternately on said eccentric part.

11. A drive arrangement in accordance with claim 1 in the form of a swivel drive and including only one expansion cell and further including external return means for returning the shaft to a starting position after expansion of the one expansion cell has caused an angular displacement of the shaft from the starting position.

12. A drive arrangement in accordance with claim 11 wherein said return means comprises an incorporated spring.

13. A drive arrangement in accordance with claim 1 wherein said expansion cell is connected to said input and output means through said eccentric part.

* * * * *